US006715416B1

(12) United States Patent
Woloszyk

(10) Patent No.: US 6,715,416 B1
(45) Date of Patent: Apr. 6, 2004

(54) POD LOADER FOR TRANSFER PAD PRINTING SYSTEM

(75) Inventor: Thomas W. Woloszyk, Sussex, WI (US)

(73) Assignee: MGS Mfg. Group, Inc., Germantown, WI (US)

( * ) Notice: Subject to any disclaimer, the term of this patent is extended or adjusted under 35 U.S.C. 154(b) by 0 days.

(21) Appl. No.: 10/289,478

(22) Filed: Nov. 6, 2002

(51) Int. Cl.[7] ..... B41F 17/00; B41M 1/00

(52) U.S. Cl. ..... 101/170; 101/41; 101/163; 101/485

(58) Field of Search ..... 101/170, 163, 101/35, 41, 150, 483, 485

(56) References Cited

U.S. PATENT DOCUMENTS 5,664,496 A * 9/1997 Scheuhing et al. ..... 101/169
6,129,012 A * 10/2000 Dietz et al. ..... 101/41
6,626,100 B2 * 9/2003 Adner ..... 101/163

* cited by examiner

*Primary Examiner*—Andrew H. Hirshfeld
*Assistant Examiner*—Leo T. Hinze
(74) *Attorney, Agent, or Firm*—Quarles & Brady LLP

(57) ABSTRACT

A loader plate attaches to a cliche used in transfer pad printing to provide an extension surface from which a sealed paint pod may be introduced to the cliche allowing the cliche to remain in registered position while transferring paint pods. A magnet system allows simple clamping of the loader plate to the cliche to simplify operation by a single user.

4 Claims, 2 Drawing Sheets

FIG. 3
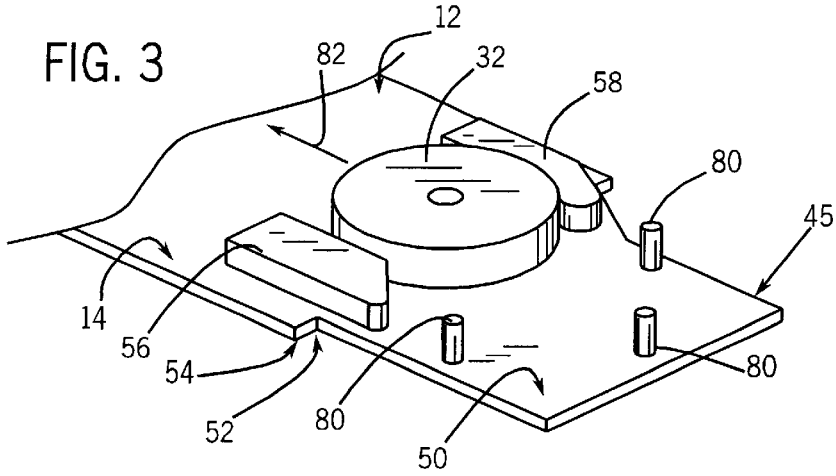
FIG. 4
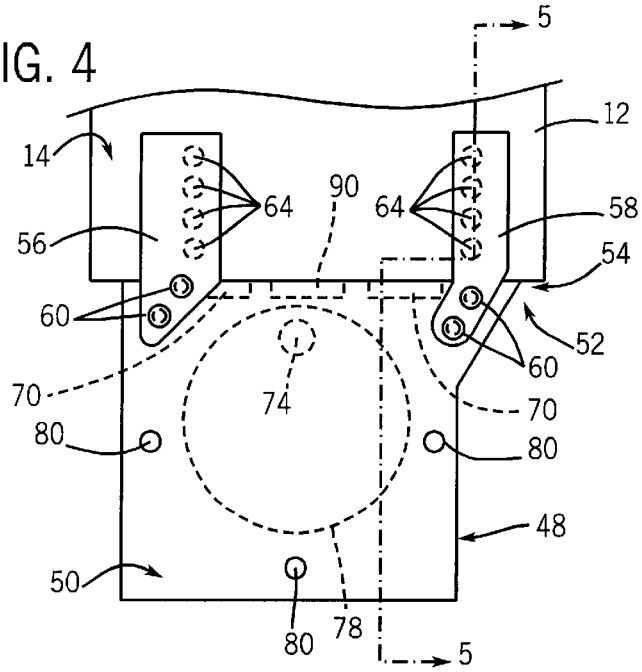
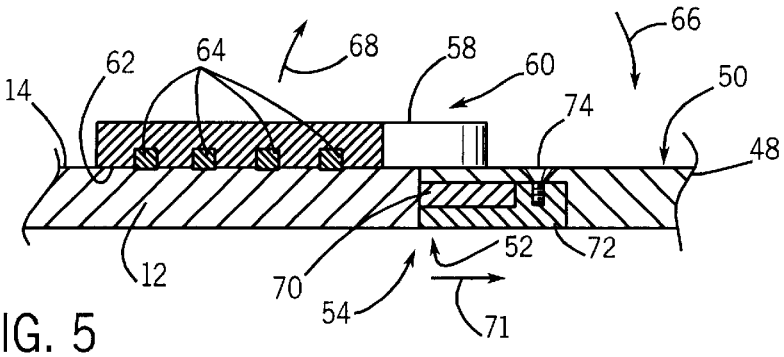
FIG. 5

POD LOADER FOR TRANSFER PAD PRINTING SYSTEM

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to transfer pad printing systems and, in particular, to a method and apparatus for loading sealed paint pods 32 or pods on such systems.

Referring to FIG. 1, a transfer pad printing system 10 provides a cliché 12 having a flat and polished upper surface 14. Shallow paint channels 16 cut or etched into the upper surface of the cliché 12 define a pattern to be printed. The cliché 12 is ferromagnetic, meaning that it is attracted to magnets but not necessarily magnetic, and may be a stainless steel plate or similar material.

During printing, the shallow paint channels 16 are filled with paint. Any extra paint on the upper surface 14 of the cliché 12 is then scraped off or "doctored". A transfer pad 20 composed of an elastomer such as silicone rubber is then positioned over the paint channels 16 as indicated by arrow 22 and pressed downward against the paint channels 16 where it deforms and accepts paint from the paint channels 16.

The transfer pad 20 is then lifted away from the cliché 12, as indicated by arrow 24, and moved to another station (not shown), where it may be pressed against a registered part to be printed (not shown), transferring to that part, the image defined by the paint channels 16.

Transfer pad printing can be extremely precise but normally requires that the cliché 12 and part be precisely registered with respect to movement of the transfer pad 20. In this regard, the cliché 12 is tightly clamped by clamping structure 28 which provide vernier adjustments 30 allowing for precise registration of the cliché 12 with the remote part and transfer pad 20.

Referring to FIGS. 1 and 2, filling the paint channels 16 in the cliché 12 may be done with a sealed paint cup or "paint pod" 32. The paint pod 32 provides a cylindrical cup having a doctoring edge 34 surrounding an opening 36 of the cup. The doctoring edge is sharpened to terminate precisely at a plane. Centered within the paint pod 32 and attached thereto is a magnet 38 having one pole face offset slightly below the doctoring edge 34.

In use, the paint pod 32 is filled with paint 40 then attached to the cliché 12. For this purpose, the cliché 12 is inverted so that upper surface 14 of the cliché 12 faces downward to cover the opening 36 of the paint pod 32. The magnet 38 pulls the upper surface 14 of the cliché 12 against the doctoring edge 34 of the paint pod 32 which together form a seal preventing leakage of the paint 40. The connected paint pod 32 and cliché 12 are then inverted putting the upper surface 14 on the upper side.

The cliché 12 is then placed within the clamping structure 28 and registered with the rest of the transfer pad printing system 10.

A pivot arm 42 is then attached to base 44 of the paint pod 32. During operation of the transfer pad printing system 10, the pivot arm 42 slides the paint pod 32 across the cliché 12 as indicated by arrow 46 in between pressings of the pad 20 against the paint channels 16. When the paint pod 32 is over the paint channels 16, it fills the paint channels 16 with paint 40. As the paint pod 32 is withdrawn, the doctoring edge 34 removes the paint from the remainder of the upper surface 14.

The sealing of the paint pod 32 against the upper surface 14 of the cliché 12 prevents evaporation of the solvent of the paint 40 during long press runs. For such long press runs, however, the amount of paint held within the paint pod 32 may be insufficient and it may be necessary to refill the paint pod 32 a number of times. This refilling process can be quite costly in terms of lost production. A particular problem is the removal of the cliché 12 and registering it again when the cliché 12 is replaced within the clamping structure 28. Precise registration is time consuming and may require test impressions to assure that the registration is correct.

BRIEF SUMMARY OF THE INVENTION

The present invention provides a method and apparatus for refilling paint pods without disturbing the cliché. By preserving the registration of the cliché, time-consuming re-registration of the cliché is eliminated.

The invention provides a loader plate that covers the pod during transfer operations. The surface of the loader plate is precisely ground and the loader plate is fitted with alignment arms so that it may attached to the cliché and the paint pod may be slid between the two without leakage of paint. Extra loader plates and paint pods allow the paint pods to be preloaded, eliminating refill time as well.

More specifically, the present invention provides a loading platform for paint pods comprising a loader plate having an upper surface sized to receive and cover a dispensing opening in the paint pod. Alignment arms attached to the loader plate engage a cliché and align a transfer edge of the loader plate into gapless abutment with an edge of the cliché so that the upper surface of the loader plate is substantially coplanar with an upper surface of the cliché. The arms flank a transfer region along the transfer edge of the loader plate sufficient in width to allow continuous sliding passage of the paint pod along the upper surface of the loader plate across the transfer region to the upper surface of the cliché.

It is thus one object of the invention to provide a simplified means of loading paint pods without removal of the cliché.

The alignment arms may extend in cantilevered fashion over the transfer edge from the upper surface of the loader plate.

It is an object of the invention to provide an alignment system that is easily viewed by the operator and that works with a wide variety of clichés, all of which can be certain to have an upper planar surface.

The cantilevered portion of the transfer arms may have a lower planar surface coplanar with the upper surface of the loader plate, and the upper surface of the cliché when engaged with the cliché.

It is thus another object of the invention to provide a simple mechanism for ensuring alignment of the upper surface of the cliché and loader plates.

The transfer arms may have embedded magnets on their cantilevered portions at the lower planar surface so that the magnets attract the cliché when the alignment arms are engaged with the cliché.

It is another object of the invention to simplify the loading process by assisting the operator in holding the loader plate against the cliché. The cantilevered arms convert out of plane tipping of the loader plate into vertical disengagement of the magnets, a mode in which they have great strength.

The alignment arms may be non-ferromagnetic.

It is thus another object of the invention to eliminate distortions in the magnet fields such as may reduce their attractive power.

The loader plate may be ferromagnetic.

Another object of the invention is to provide a loader plate that attracts the magnet of the paint pod preventing slippage or premature release of paint.

The plate may include an upwardly extending fence structure preventing continuous sliding passage of the paint pod along the upper surface of the loader plate, off the loader plate, except across the transfer region.

Thus, it is another object of the invention to eliminate possible paint leakage caused by sliding of the paint pod in directions other than onto the cliché.

The transfer edge of the loader plate may further include magnets providing in-plane attraction of the loader plate to the cliché.

Thus, it is another object of the invention to provide a force holding the cliché and loader plate together that supplements the magnets in the attachment arms, which provide lesser sliding resistance.

The loader plate upper surface provides a surface finish and flatness so that the paint pod, when loaded with paint, may be slid along the upper surface without substantial loss of paint.

Thus, it is another object of the invention to generally match the surface flatness and finish of the cliché.

The transfer edge may include at least one pocket for accepting a projection of cliché retaining structure when the cliché is held in the retaining structure facilitating engagement of the loader plate and cliché.

Thus, it is another object of the invention to accommodate a clamping structure holding the cliché without removal of that clamping structure which might affect registration.

These particular objects and advantages may apply to only some embodiments falling within the claims and thus do not define the scope of the invention.

BRIEF DESCRIPTION OF THE DRAWINGS

FIG. 3 is a perspective view of the cliché attached to a loader plate of the present invention showing sliding disengagement of a paint pod from the loader plate onto the cliché;

FIG. 4 is a top plan view of the loader plate of FIG. 3 showing its attachment to the cliché as positioned and held by attachment arms with lower surface magnets and showing the position of a fence structure for reducing movement of the paint pod on the loader plate; and FIG. 5 is a cross-sectional view along line 5—5 of FIG. 4 showing edge magnets, which supplement the magnets in the attachment arms for holding the loader plate against the cliché.

DETAILED DESCRIPTION OF THE PREFERRED EMBODIMENT

Figure 1:
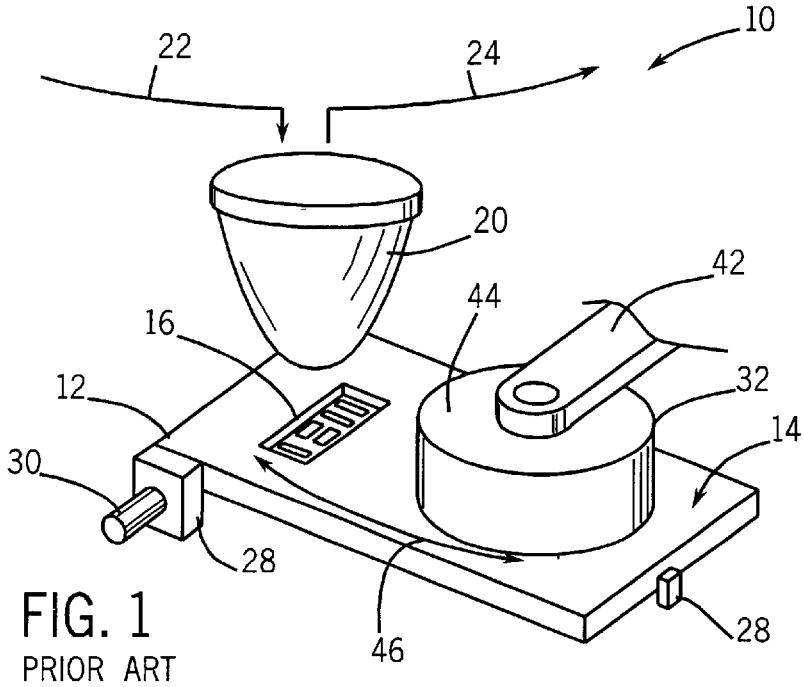
FIG. 1 PRIOR ART
FIG. 1 is a perspective view of a prior art transfer press system described above showing the paint pod in position against the cliché.

Referring now to FIGS. 3 and 4, the present invention provides a loader plate 48 providing a planar upper surface 50 having a surface finish and flatness commensurate with the upper surface 14 of the cliché 12.

The loader plate 48 is preferably a ferromagnetic stainless steel and may be constructed, for example, of the same material as the cliché 12.

The loader plate 48 provides a transfer edge 52 that may abut a corresponding edge 54 of the cliché 12. Each of the edges 52 and 54 are generally perpendicular to the upper surfaces 14 and 50 and abut to eliminate gaps there between. Preferably, the transfer edge 52 is straight line such as to be readily adaptable to a variety of clichés 12, which normally has a corresponding flat edge.

Alignment arms 56 and 58 are attached at one end to the upper surface 50 of the loader plate 48 by machine screws 60 and extend in cantilever fashion from the loader plate 48.

Referring momentarily also to FIG. 5, each of the attachment arms 56 and 58 provide a planar lower surface 62 that, at one end, may rest against the planar upper surface 14 of the cliché 12 and, at the other end, is retained against the planar upper surface 50 of the loader plate 48. Thus, when bridging the two upper surfaces 14 and 50, the alignment arms 56 and 58 bring upper surfaces 14 and 50 into alignment in a single plane.

Retention of lower surface 62 of attachment arms 56 and 58 in abutment with the upper surface 14 and cliché 12 is provided by a series of eight magnets 64 flush with the lower surface 62 of arms 58 and 56. In the preferred embodiment, each of the magnets will have a 3.5 lb. rating and will be ground flush to the lower surface 62 so as to provide very little gap between the magnets and the cliché 12 increasing their pull. Further, the arms 58 and 56 are constructed of a non-ferromagnetic material, preferably aluminum, so as not to interfere with the magnetic fields of the magnets or mar the upper surface 14 of the cliché 12.

Downward forces 66 on the loader plate 48 caused for example, by the weight of a paint pod 32 or operator manipulation, will translate into an upward force 68 on the cantilevered portion of the arms 58 and 60 causing a pulling of the magnets 64 away from the ferromagnetic cliché 12, a direction in which the magnetic resisting force is strongest. Nevertheless, the magnets 64 may be disengaged easily by sliding them along the polished upper surface 14 of the cliché 12 under the influence of an in-plane force 71.

Added resistance to this in-plane force 71 may be provided by a second set of magnets 70 positioned at the transfer edge 52 below the upper surface 50 of the loader plate 48 to attract the edge 54 of the cliché 12. Magnets 70 may be held by a retention clamp 72 providing one side of a pocket beneath the upper surface 50 of the loader plate 48. The retention clamp 72 grips the magnets 70 as pulled against the remainder of the loader plate 48 by a machine screw 74. Magnet 70 may be ground substantially flush with the edge 52 to minimize the gap therebetween.

Referring again to FIG. 4, the head of machine screw 74 holding the retention clamp is accessible at the upper surface 50 of the loader plate 48 and may be counter sunk, and then covered with an epoxy material flush with the remainder of the upper surface 50.

Referring again to both FIGS. 4 and 5, the upper surface 50 of the loader plate 48 provides an area 78 sufficient to hold a paint pod 32. Arms 56 and 58 are separated to provide a transfer region between them sufficient for the paint pod 32 to slide from the area 78 onto the cliché 12 without obstruction.

Dowel posts 80 may extend upward from the upper surface 50 of the loader plate 48 so as to provide a fence structure preventing sliding of the paint pod 32 except onto the cliché 12 as indicated by arrow 82.

Referring to FIG. 4, a pocket 90 may be cut into the transfer edge 52 of the loader plate 48 beneath the upper surface 50 to accommodate clamping structures 28 (for example, as shown in FIG. 1) according to the particular application.

Figure 2:
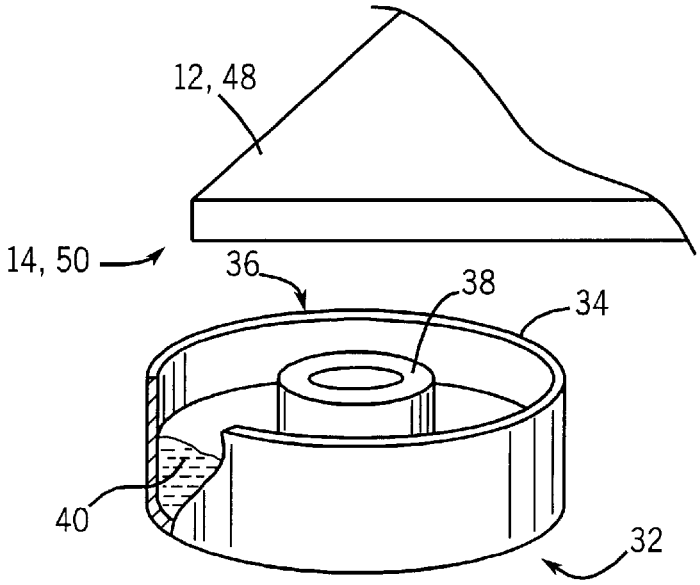
FIG. 2 is an inverted, perspective view of the paint pod in partial cutaway showing the doctoring edge, interior magnet, and contained paint prior to attachment to a cliché.

Referring to FIG. 2, in operation, the loader plate 48 may be used instead of the cliché 12 for covering the opening 36 of a paint filled paint pod 32. The joined loader plate 48 and cliché 12, held by operation of the magnet 38, may then be inverted and the transfer edge 52 of the loader plate 48 engaged against the edge 54 of the cliché 12 as shown in FIG. 3. Magnets 64 in alignment arms 56 and 58 hold the upper surface 50 of the loader plate 48 co-planar with the upper surface 14 of the cliché 12, while magnets 70 pull the transfer edge 52 of the loader plate 48 against edge 54 of the cliché 12 eliminating any gap between the two. As held, a single operator may slide the paint pod 32 as shown by arrow 82 onto the cliché 12 and attached to the pivot arm 42 as shown in FIG. 1.

By using additional paint pods 32 and loader plates 48, the time required to fill paint pods 32 may be eliminated from the changeover time. A second loader plate 48 (not shown) may be used to remove the empty paint pod 32 through the reverse of the above process eliminating paint drips from the empty paint pod 32 as it is removed from the cliché 12.

It is specifically intended that the present invention not be limited to the embodiments and illustrations contained herein, but include modified forms of those embodiments including portions of the embodiments and combinations of elements of different embodiments as come within the scope of the following claims.

I claim:

1. A method of loading paint pods onto a cliché of a transfer press system comprising the steps of:

(a) inverting a paint pod so that a dispensing opening from which paint is dispensed during transfer printing faces upward;

(b) filling the paint pod so inverted;

(c) covering the dispensing opening of the paint pod with an upper surface of a loader plate;

(d) righting the paint pod and loader plate combination;

(e) using alignment arms releasably joining the loader plate and cliché to align a transfer edge of the loader plate into gapless abutment with an edge of the cliché so that the upper surface of the loader plate is substantially co-planar with an upper surface of the cliché;

(f) sliding the paint pod along the upper surface of the loader plate across the transfer region to the upper surface of the cliché; and (g) removing the loading plate from the cliché.

2. The method of claim 1 wherein the alignment arms are mechanically attached to the loader plate and magnetically attached to the cliché.

3. The method of claim 1 wherein the transfer arms have a lower planar surface co-planar with the upper surface of the loader plate and the upper surface of the cliché when the loader plate is joined with the cliché.

4. The method of claim 1 wherein the paint pod includes a magnet for attracting the cliché and wherein the loader plate is ferromagnetic.

* * * * *